US005332989A

United States Patent [19]

Ching

[11] Patent Number: 5,332,989

[45] Date of Patent: Jul. 26, 1994

[54] HORIZONTAL COMPARTMENTIZED SQUARE BOBBIN OF HIGH-VOLTAGE TRANSFORMER

[76] Inventor: Chiu S. Ching, No. 90, Pao Chung Rd., Hsin Tien City, Taipei Hsien, Taiwan

[21] Appl. No.: 930,939

[22] Filed: Aug. 17, 1992

[51] Int. Cl.[5] ..... H01F 27/30

[52] U.S. Cl. ..... 336/208; 242/118.41; 336/185

[58] Field of Search ..... 336/198, 208, 185, 192; 242/118.4, 118.41; 361/41

[56] References Cited

U.S. PATENT DOCUMENTS

| | | | |
|---|---|---|---|
| 2,355,477 | 8/1944 | Stahl | 336/192 |
| 3,117,294 | 1/1964 | Muszynski et al. | 336/192 |
| 3,661,342 | 5/1972 | Sears | 336/208 |
| 4,274,136 | 6/1981 | Onodera et al. | 336/208 |
| 4,454,554 | 6/1984 | Coleman | 361/41 |
| 4,862,130 | 8/1989 | Ellison | 336/198 |
| 4,904,975 | 2/1990 | Medenbach | 242/118.41 |

FOREIGN PATENT DOCUMENTS

| | | | |
|---|---|---|---|
| 2309023 | 11/1976 | France | 336/198 |

*Primary Examiner*—Thomas J. Kozma
*Attorney, Agent, or Firm*—Lowe, Price, LeBlanc & Becker

[57] ABSTRACT

A high-voltage transformer winding bobbin made from a heat-resisting, insulative plastic material through the process of injection molding, which includes a plurality of square flanges equidistantly spaced around the hollow, cylindrical, square body thereof and a plurality of winding grooves respectively defined between each two adjacent square flanges for winding an enamel wire, wherein the square flanges except the last one, have each a V-shaped wire guiding notch on a respective peripheral edge. The V-shaped wire guiding notches on the square flanges are respectively aligned for guiding an enamel wire into each winding groove. In an alternate form, the V-shaped wire guiding notches on the square flanges of odd numbers are aligned and respectively disposed diagonal to the V-shaped wire guiding notches on the square flanges of even numbers.

3 Claims, 2 Drawing Sheets

HORIZONTAL COMPARTMENTIZED SQUARE BOBBIN OF HIGH-VOLTAGE TRANSFORMER

BACKGROUND OF THE INVENTION

The present invention relates to a high-voltage transformer winding bobbin which has a plurality of winding grooves separated by square flanges for winding an enamel wire into separate windings efficiently.

A high-voltage transformer according to the prior art is generally comprised of a core having a plurality of windings wound thereon one around another and respectively separated from one another by a respective sheet of insulator paper. According to this arrangement, the impedance of the windings is directly proportional to the distance from the core. Therefore, an outer winding produces a relatively higher impedance. Because increasing the impedance of a winding simultaneously increases its temperature, an outer winding may be burnt down easily. Because the windings are wound on the core one around another, longer enamel wires is used for making a transformer of the same capacity and much labor is required for winding the windings and the sheets of insulator paper. After the process of winding, the whole assembly is attached with silicon steel core brade and dipped in a varnish solution for coating. If the sheets of insulator layer are not properly wrapped, the quality of the transformer is greatly affected. Furthermore, the use of the sheets of insulator paper greatly increases the size of the winding assembly and the silicon steel core brades, and therefore the total weight and manufacturing cost of the transformer are relatively increased.

SUMMARY OF THE INVENTION

The present invention eliminates the aforesaid disadvantages. According to one aspect of the present invention, a high-voltage transformer winding holder is generally made from a heat-resisting, insulative plastic material through the process of injection molding, which has a plurality of winding grooves separated by square flanges for winding an enamel wire into separate windings efficiently. According to another aspect of the present invention, the square flanges have each a V-shaped wire guiding notch on the respective peripheral edge for guiding the enamel wire into each winding groove. According to still another aspect of the present invention, the V-shaped wire guiding notches on the square flanges are respectively aligned for guiding an enamel wire into each winding groove. According to still another aspect of the present invention, the V-shaped wire guiding notches on the square flanges of odd numbers may be aligned and respectively disposed diagonal to the V-shaped wire guiding notches on the square flanges of even numbers.

BRIEF DESCRIPTION OF THE DRAWINGS

FIG. 1—2 is a perspective view of an alternate form of the high-voltage transformer winding holder according to the present invention;

FIG. 2 is a sectional view of the high-voltage transformer winding holder of FIG. 1.

DETAILED DESCRIPTION OF THE PREFERRED EMBODIMENTS

Figure 1:
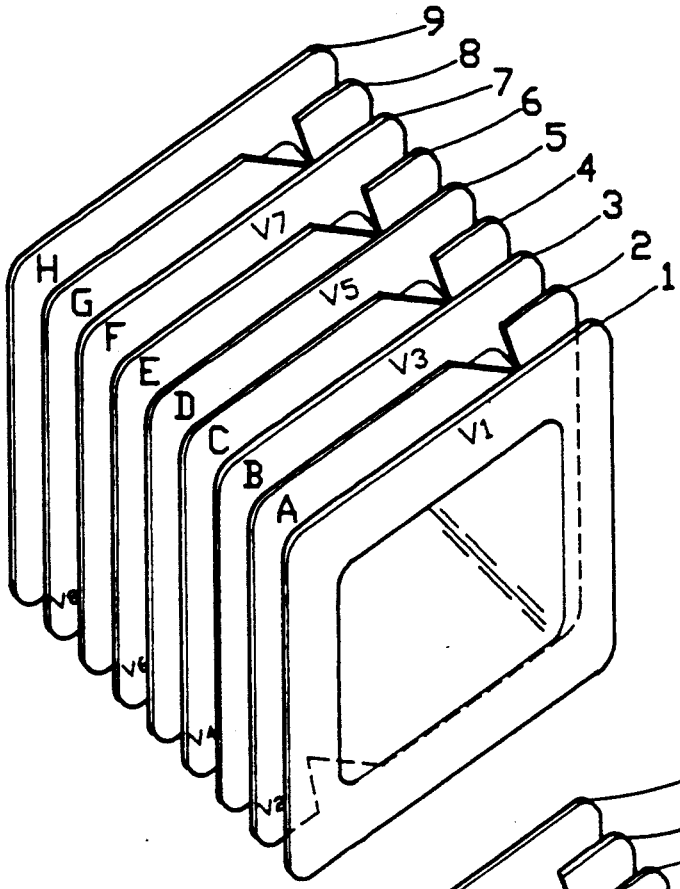
FIG. 1—1 is a perspective view of a high-voltage transformer winding holder according to the present invention.

Referring to FIG. 1—1 a high-voltage transformer winding holder according to the present invention is made from a heat-resisting, insulative plastic material through the process of injection molding having a plurality of square flanges 1,2,3,4,5,6,7,8,9 around a hollow, cylindrical, square body thereof equidistantly spaced from one another and defining a plurality of winding grooves A,B,C,D,E,F,G,H. The square flanges 1,2,3,4,5,6,7,8, except the last square flange 9, have each a V-shaped wire guiding notch V1,V2,V3,V4,VS,V6,V7 and V8 on the respective peripheral edge. In FIG. 1—1, the V-shaped wire guiding notches on the square flanges of odd numbers 1,3,5,7 are arranged in line while the V-shaped wire guiding notches on the square flanges of even numbers 2,4,6,8 are arranged in line diagonal to the line through the V-shaped wire guiding notches on the square flanges of odd numbers 1,3,5,7. As an alternate form of the present invention, the V-shaped wire guiding notches on the square flanges may be all arranged in line (see FIG. 1—2).

Figures 1, 2:
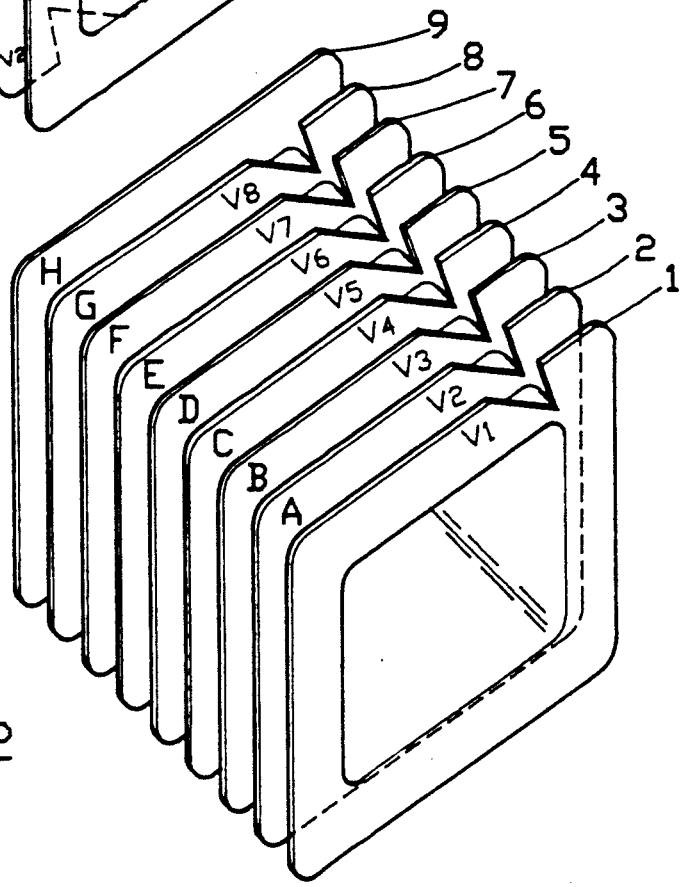
Figure 2:
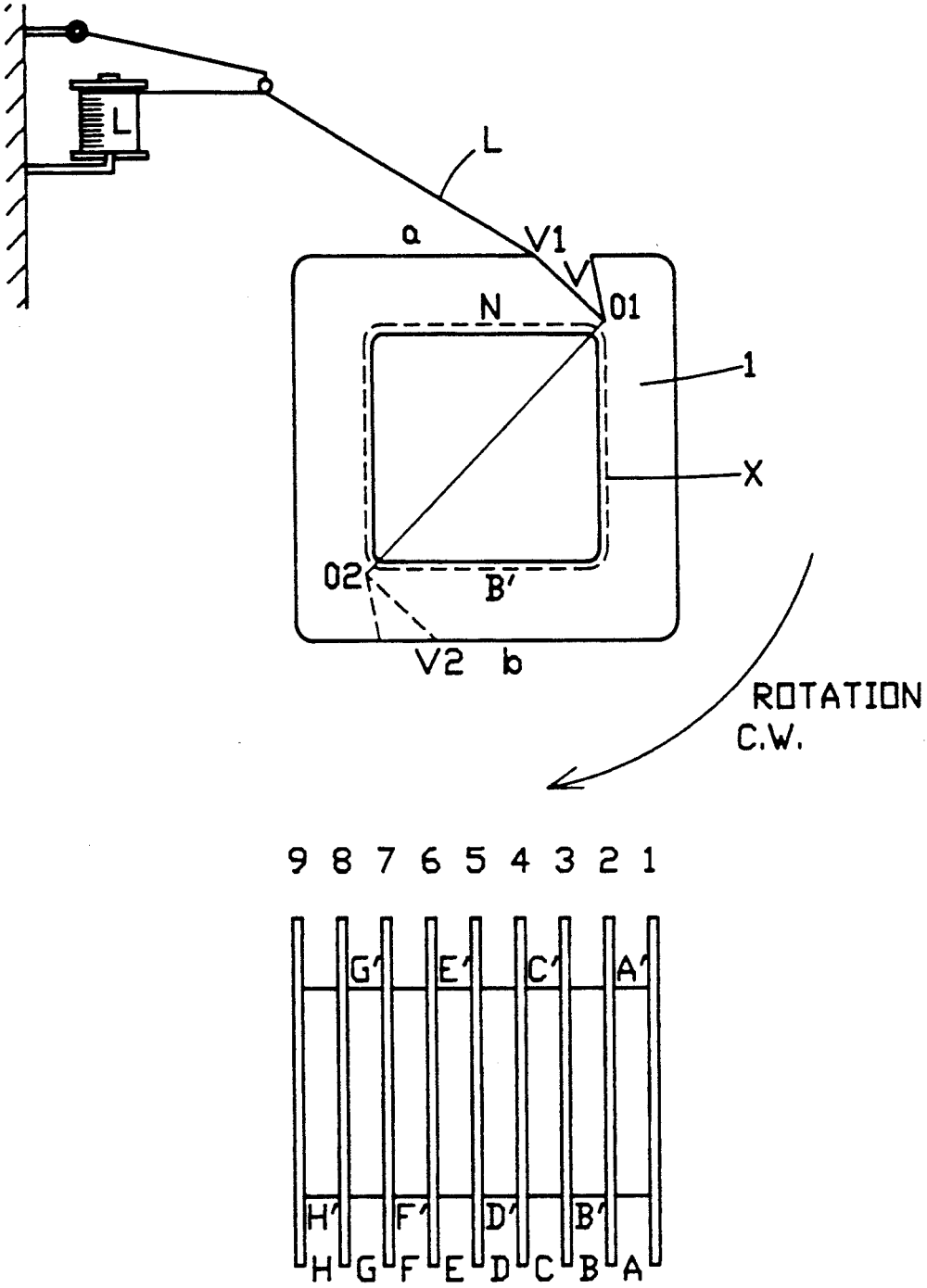

Referring to FIG. 2, the rectangular flange 1 has a V-shaped wire guiding notch V on an side edge a thereof. The depth of the V-shaped wire guiding notch V reaches the adjacent corner 01 of the core X. The inner slope V1-01 of the V-shaped wire guiding notch V is at right angle relative to the diagonal from the connected corner 01 to the diagonal corner 02. Therefore, rotating the core X clockwise causes the enamel wire L to be automatically guided through from the corner 01 through the slope V1-01 into the bottom A' of the first winding groove A, and then be guided through the corner 02 into the bottom B' of the next winding groove B after it has been wound around the first winding groove A through a predetermined number of runs. The same procedure is repeated again and again until the last winding groove H has been properly wound by the enamel wire L through a predetermined number of runs. Because each the windings in the winding grooves are respectively separated by the square flanges, no any insulator paper is needed. Therefore, the winding process can be down within a short length of time.

What is claimed is:

1. A high-voltage transformer winding bobbin made from a heat-resisting, insulative plastic material through the process of injection molding having a plurality of square flanges equidistantly spaced around a hollow, cylindrical, square in cross section core and a plurality of winding grooves respectively defined between each adjacent pair square flanges for winding an enamel wire, said square flanges including a stop flange at one end and a plurality of wire guiding flanges, each of said wire guiding flanges having each a V-shaped wire guiding notch on a respective peripheral edge each notch extending to a depth of and aligned with a corner of said core and having a first side contained in a plane disposed at a first angle to the horizontal and a second side contained in a plane disposed perpendicular to the plane containing the diagonal of said core passing through said corner and a diagonal corner.

2. The high-voltage transformer winding bobbin according to claim 1 wherein the V-shaped wire guiding notches on the wire guiding flanges of odd numbers are aligned and respectively disposed diagonal to the V-shaped wire guiding notches on the wire guiding flanges of even numbers.

3. The high-voltage transformer winding bobbin according to claim 1 wherein the V-shaped wire guiding notches on the wire guiding flanges are arranged in line.

* * * * *